US007621795B2

(12) United States Patent
Drescher

(10) Patent No.: US 7,621,795 B2
(45) Date of Patent: Nov. 24, 2009

(54) CRITERATURE

(76) Inventor: Robert S. Drescher, 241 W. 97th St., #4N, New York, NY (US) 10025

( * ) Notice: Subject to any disclaimer, the term of this patent is extended or adjusted under 35 U.S.C. 154(b) by 743 days.

(21) Appl. No.: 11/031,502

(22) Filed: Jan. 6, 2005

(65) Prior Publication Data

US 2007/0184748 A1 Aug. 9, 2007

Related U.S. Application Data

(60) Provisional application No. 60/534,556, filed on Jan. 6, 2004.

(51) Int. Cl.
*A63H 3/02* (2006.01)
*B42H 1/00* (2006.01)

(52) U.S. Cl. ..... 446/72; 446/74; 446/369; 281/15.1

(58) Field of Classification Search ..... 446/71, 446/72, 74, 25–27, 299, 302, 369, 370, 268; 281/15.1, 21.1, 18, 24, 31, 35
See application file for complete search history.

(56) References Cited

U.S. PATENT DOCUMENTS 4,909,542 A * 3/1990 Marks ..... 281/15.1
5,472,364 A * 12/1995 Castleman ..... 446/71
5,749,764 A * 5/1998 Bailey ..... 446/427
6,165,038 A * 12/2000 Muller ..... 446/219
6,254,450 B1 * 7/2001 Schonberger ..... 446/72
6,755,712 B2 * 6/2004 Morris ..... 446/98

* cited by examiner

*Primary Examiner*—Kien T Nguyen
(74) *Attorney, Agent, or Firm*—Maldjian & Fallon LLC; Jon Fallon, Esq.

(57) ABSTRACT

My invention, "Criterature", will combine an accessible reading experience with the comforting presence of stuffed animals or stuffed toys in a new way so that a child can literally discover reading while holding a comforting stuffed animal in the shape of an animal, creature, character, element etc. featured in a book pouched within the stuffed animal or stuffed toy. The book will also be in the shape of an animal, creature, character, element etc., featured in the book. The book will be pouched via a reseal able opening and pouch that will be as undetectable as possible beneath a deep, plush coat or cover. Children of all ages and adults can be engaged and inspired together by "Criterature" that will combine a hidden treasure of a pouched book with the warmth of a huggable stuffed animal or stuffed toy that will serve as a safe and convenient way to transport and store literature that can lead to further reading and learning experiences including those via "Criterature Critters," "Criterature" books, "Criterature" video adventures, dvds, broadcasts, web links etc.

6 Claims, 1 Drawing Sheet

Figure # 1
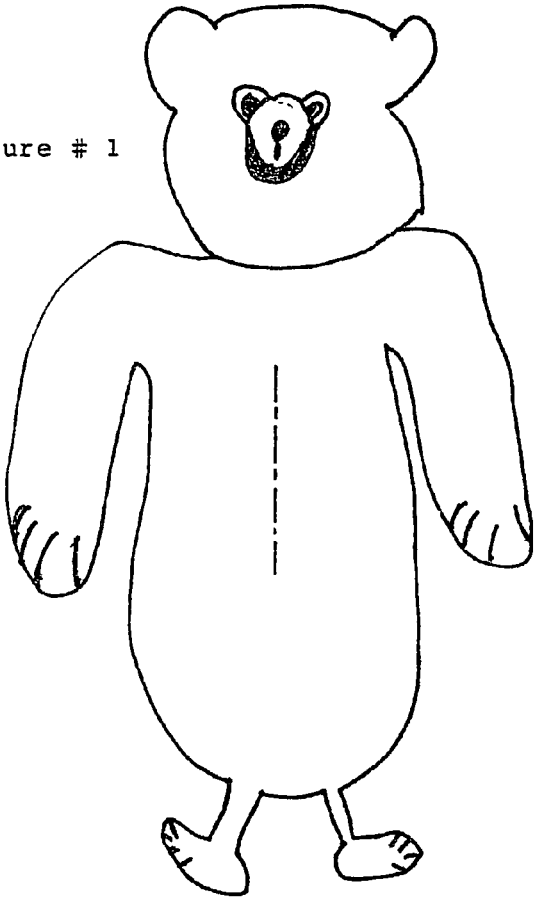
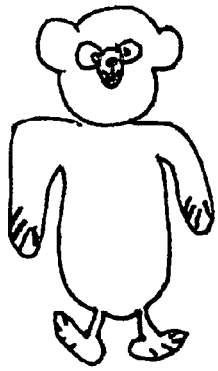
Figure # 2

CRITERATURE

CROSS REFERENCE TO RELATED APPLICATIONS

This application claims priority to my provisional patent application No. 60/534,556 filed on Jan. 6, 2004.

STATEMENT REGARDING FED SPONSORED R&D

"Not Applicable"

REFERENCE TO SEQUENCE LISTING etc.

"Not Applicable"

BACKGROUND OF THE INVENTION

My invention, "Criterature", can make reading more interesting and accessible to young and older readers via my idea of stories, poems etc. about animals, wildlife, pets, and other characters being conveyed via soft books in the shape of those animals or story elements pouched within comforting stuffed animals or stuffed toys also in the shape of creatures, character, elements of the stories. Since conceiving "Criterature" and after writing the first five "Criterature" books I've been told by colleagues or acquaintances with extensive experience in marketing children's books and toys and by several educators including a reading specialist, that my invention can provide some improvements in the fields of publishing, education and toys. I've been advised that animals are the most popular subjects for children's books. I've been told that publishers have historically given plush, stuffed animals as premiums accompanying children's books but that my invention, "Criterature", wherein a stuffed animal or stuffed toy does not just accompany a book but actually serves as a way to provide via a secret pouch a way to convey a story or book as a kind of hidden treasure, can thus create a new level of interest in reading for children as well as be an aid to adults who are always on the lookout for ways to make reading more alluring and interesting to children.

Beyond sheltering an engaging surprise of a book in the shape of an animal or creature or character discussed in the book within its secret pouch, "Criterature" stuffed animals will serve as a safe, child and parent pleasing, instructively organizing way to convey and store literature that is linked with the warm associations that come with a comforting stuffed animal or stuffed toy. I have been further advised by people who work in publishing, marketing and education and via informal surveys of various age groups, including children age 2-17 and adults and parents, that my "Criterature" concept and content appeal to both young and older readers. I've been told by educators that this mutual interest in "Criterature" can help to connect child and parent and others in a very enriching, bonding experience of enjoying reading together thus creating another improvement in the field of books, toys, publishing, education etc. by attracting a wide age range of readers to sharing mutually appreciated comforting stuffed toys and the stories/poems etc. found within "Criterature" and the various other learning experiences inspired by "Criterature" including animal/pet adventure/educational programing that can accompany "Criterature" and or be available with additional information and further programing via a "Criterature" web site, broadcasts etc.

BRIEF SUMMARY OF THE INVENTION

The driving concept of "Criterature" is my idea wherein stories will be conveyed via a book that will be cut in the shape of an animal, creature, character etc. featured in the book and carried and safely stored inside a hidden resealable pouch within a stuffed animal or stuffed toy depicting an animal, creature, character or element featured within the book. "Criterature" will be a new way to interest children of all ages in reading and further learning experiences while also providing a new way to organize, carry and store literature.

BRIEF DESCRIPTION OF THE DRAWING

Please see my enclosed drawing with

FIG. 1—suggesting a stuffed toy in the shape of an animal, creature, character, element etc. featured in the book pouched within its hidden resealable pouch (with pouch signified by the dotted line in the middle of FIG. 1) and FIG. 2—representing a book in the shape of an animal, creature, character, element * etc. featured in the story to be pouched within the stuffed animal or stuffed toy. In this drawing as an example of my "Criterature" concept, the drawing suggests how a copy of the book I've written about a bear will be printed and illustrated and cut in the shape of a bear and stored via a hidden opening and pouch inside the stuffed toy bear and be removable and returnable via the resealable pouch. (* The story element of the stuffed toy (FIG. 1) and story element of the book (FIG. 2) need not be the same. i.e. a dog shaped book can be pouched in a stuffed bone or a bone shaped book can be pouched in a stuffed toy dog.)

DETAILED DESCRIPTION OF THE INVENTION

The driving concept of "Criterature" is my idea that stories about animals, wildlife, pets and other characters, elements etc. will be conveyed via a book printed that will be cut in the shape of an animal, creature, character, element etc. featured in the book and stored safely inside a stuffed animal depicting an animal , creature, character, element etc. featured in the book. For illustration, please see my enclosed drawing with FIG. 1, the stuffed animal in the shape of an animal, creature, character, element etc., featured in the book found within its hidden pouch and FIG. 2, a book in the shape of an animal, creature, character etc. featured in the book to be pouched within the stuffed animal . For example, a copy of the book I've written about a bear will be printed and illustrated and cut in the shape of a bear and tucked via the hidden opening and pouch inside the stuffed animal bear and be removable and returnable via the reseal able pouch. Books written about other animals, creatures or characters would thus be made in a similar fashion wherein the book would be shaped to represent an animal, creature or character featured in the story and fit into the hidden pouch of the stuffed animal of stuffed toy also in the shape of an animal, creature, character, element etc., featured in the story. "Criterature" provides a new way to engage an interest in reading while also providing a new way to carry and store literature. Though I currently imagine a "velcro"—like reseal able pouch opening and soft book carrying pouch to be hidden below a deep, plush coat, the exact materials and form of the reseal able pouch and book that it will carry are to be determined via discussions with state of the art stuffed animal manufacturers, book publishers and various craftspeople, technicians, manufacturers and suppliers who can help construct "Criterature" with the highest level of safety while making the pouch and book as close as possible to undetectable so as not to impinge upon the comforting, huggable coziness of the stuffed animal.

The words "Criterature", "Cozy Criterature" etc., (words/titles by R.S.D.) will also be used in ways that include but are not limited to titles for a film, tv, video, internet, series of adventures, explorations inspired by "Criterature" that will be filmed/taped etc. showing wildlife adventures/explorations in which the audience shares the experience of learning about animals, wildlife, pets etc. with the host/hosts who visit the creatures in their habitat or homes or other locations where the host(s) and audience will learn about animals, wildlife etc. For example, in March of 2002 I filmed on digital video the first of these experiences in progress observing with my niece beavers in their natural habitat in Ridgefield, Ct. This video is to be supplemented with further footage including input from wildlife specialists etc. "Critteos" is another word I've created as a title for the above described real or imagined experiences with animals, wildlife etc. to be further developed, recorded, produced, edited on video/film etc. These and other animal, wildlife etc. adventures, educational experiences, stories etc., will be shared in ways that include being shown on broadcast or cable television programming, via internet streaming video, video cassette or dvd, theatrical film, and or any and all ways of showing or projecting recorded experiences or imagined adventures etc. to be shared with a viewing audience. Ideally a dvd or video copy of a "Critteo" will be available with each "Criterature" stuffed animal or stuffed toy for the child's viewing with parents' supervision and or for viewing by children who are capable of using video/dvd etc. viewing equipment such as video decks, dvd players, monitors, televisions, computers etc. Criterature for older kids and adults not at risk of being injured by hard cover books and dvd(s) and cases etc. carried within the "Criterature" pouch could be developed using the same basic concept illustrated in the enclosed drawing. The harder material carrying "Criterature" if developed/manufactured would include appropriate age advisory information.

"Criterature" will also be used in ways that include but are not limited to a title for the subject matter that will be the cause of discussion for visitors to a "Criterature" etc. web site where "Criterature" readers, collectors etc. from around the world can meet online in a virtual clubhouse for reasons that include but are not limited to discussing their "Criterature" reading, real life and make believe "Criterature" animal, wildlife, pet and other characters adventures and stories as well as purchase and send as gifts "Criterature" books, stuffed "Criterature Critters" (title created by R.S.D.), "Critteo" videos, dvds, online downloads etc.

The invention claimed is:

1. A kit consisting of:

a plush figure having a single pouch, the pouch provided in a chest portion of the plush figure, the pouch having a substantially resealable opening provided by a plurality of hook-and-loop fasteners, and the pouch being completely defined within the chest portion of the plush figure;

a soft-cover book containing a story about at least one of an animal, creature, character, or element, fully concealed and removably contained within the pouch of the plush figure;

wherein the shape of the plush figure and the shape of the soft-cover book are substantially similar to at least one of the animal, creature, character, or element; and wherein the resealable opening is substantially visually undetectable in a closed position.

2. The kit of claim 1, wherein the shape of the plush figure and the shape of the soft-cover book are substantially the same.

3. The kit of claim 1, wherein the plush figure is in the shape of a bear.

4. The kit of claim 1, wherein the plush figure is in the shape of a dog or a bone.

5. A kit consisting of:

a bear-shaped plush figure having a single pouch, the pouch provided in a chest portion of the plush figure, the pouch having a substantially resealable opening provided by a plurality of hook-and-loop fasteners, and the pouch being completely defined within the chest portion of the plush figure; and a soft-cover bear-shaped book containing a story about at least a bear, fully concealed and removably contained within the pouch of the bear-shaped plush figure;

wherein the resealable opening is substantially visually undetectable in a closed position.

6. A kit consisting of:

a dog-shaped plush figure having a single pouch, the pouch provided in a chest portion of the plush figure, the pouch having a substantially resealable opening provided by a plurality of hook-and-loop fasteners and the pouch being completely defined within the chest portion of the plush figure; and a soft-cover bone-shaped book containing a story about at least a dog, fully concealed and removably contained within the pouch of the dog-shaped plush figure;

wherein the resealable opening is substantially visually undetectable in a closed position.

* * * * *